US005823225A

United States Patent [19]

Erickson et al.

[11] Patent Number: 5,823,225

[45] Date of Patent: Oct. 20, 1998

[54] COLLAPSIBLE CONTAINER FOR HAULING BULK MATERIALS

[75] Inventors: Stewart E. Erickson; Daniel J. Halvorson, both of Hudson, Wis.

[73] Assignee: SEEC, Inc., Mendota Heights, Minn.

[21] Appl. No.: 443,107

[22] Filed: May 17, 1995

Related U.S. Application Data

[63] Continuation of Ser. No. 233,111, Apr. 25, 1994, which is a continuation-in-part of Ser. No. 190,989, Feb. 3, 1994.

[51] Int. Cl.[6] ..... B61D 5/00

[52] U.S. Cl. ..... 137/347; 105/359; 105/423; 220/1.5; 383/902

[58] Field of Search ..... 105/423, 359; 383/902; 220/1.5; 137/347

[56] References Cited

U.S. PATENT DOCUMENTS

| | | | |
|---|---|---|---|
| 2,712,797 | 7/1955 | Woehrle | 296/39 |
| 2,931,523 | 4/1960 | Nelligan | 214/82 |
| 3,806,185 | 4/1974 | Brandjord | 296/98 |
| 3,962,959 | 6/1976 | Williamson . | |
| 4,013,018 | 3/1977 | Hansen et al. | 105/468 |
| 4,113,146 | 9/1978 | Williamson . | |
| 4,143,796 | 3/1979 | Williamson et al. . | |
| 4,186,845 | 2/1980 | Podd . | |
| 4,224,970 | 9/1980 | Williamson et al. . | |
| 4,253,507 | 3/1981 | Williamson . | |
| 4,340,379 | 7/1982 | Williamson . | |
| 4,457,456 | 7/1984 | Derby et al. . | |
| 4,461,402 | 7/1984 | Fell et al. | 222/105 |
| 4,470,749 | 9/1984 | Koudstaal | 414/539 |
| 4,479,243 | 10/1984 | Derby et al. . | |
| 4,541,765 | 9/1985 | Moore | 414/267 |

(List continued on next page.)

OTHER PUBLICATIONS

B.A.G. Corp. brochure with cover letter dated Mar. 1995.
Powertex Inc. brochure ©1992.
Semi–Bulk Systems, Inc. brochure ©1982.
Bulk Lift brochure with cover letter ©1992.
B.A.G. Corp. brochure "the Exclusive Source for Super Sack® Containers," with cover letter dated 30 Nov. 1994.
B.A.G. Corp. brochure for Super Sack De–Aerator dated May 1992.
National Paperboard Group, Inc. brocure "Rhino Bulk Bags" 1994.
Cajun Bag & Supply Co. brochure with cover letter dated Jan. 1995.
Cajun Bag & Suply Co. sizing chart, 1994.
Helios Container Systems, Inc. brochure with cover letter, 1994.
Brochure of Amfuel entitled "Fabribin® Cuts Costs on Shipping/Handling/Storage!" ©1991.
Brochure of Uniroyal Sealdtank® "Now . . . Haul Liquid Lading in Any Dry Bed." ©1985.
An Introduction to Biogas Production on the Farm, The NationalCenter for Appropriate Technology, U.S. Dept. of Energy, Contact No. DE–AC01–82CE15095, pub. Mar., 1984.
Advertisement for The Eldred Environmental & Export Co., Inc., Pollution Equipment News, Mar. 1994, vol. 27 No. 2, p. 6.
Advertisement for the Packaging Research & Design Corp., Pollution Equipment News, Mar. 1994, vol. 27 No. 2 p. 42.

*Primary Examiner*—A. Michael Chambers
*Attorney, Agent, or Firm*—Fredrikson & Byron, PA

[57] ABSTRACT

A collapsible container for hauling certain bulk materials in freight vehicles. The container includes a generally flexible barrier that defines a collapsible cavity in which bulk materials may be controlled during transportation. The flexible barrier includes at least one port for passing material into and out of the cavity, as well as a cover for closing the port. To assist in the loading and unloading, the container includes a lifting member for engagement with a crane, a strap attached to the lifting member and the barrier, and a ring attached to the lower portion of the barrier. The strap provides support to the barrier as it is lifted and suspended during loading and unloading from a freight vehicle. The ring is provided to hold the container in place as it is inverted to discharge the materials from the cavity.

17 Claims, 14 Drawing Sheets

U.S. PATENT DOCUMENTS

| | | | |
|---|---|---|---|
| 4,542,764 | 9/1985 | Brittingham et al. . | |
| 4,557,400 | 12/1985 | Clarke | 222/105 |
| 4,613,053 | 9/1986 | Kimura et al. | 220/22 |
| 4,691,371 | 9/1987 | Derby . | |
| 4,759,473 | 7/1988 | Derby et al. . | |
| 4,799,607 | 1/1989 | Podd . | |
| 4,833,008 | 5/1989 | Derby . | |
| 4,878,600 | 11/1989 | Derby . | |
| 4,903,859 | 2/1990 | Derby et al. . | |
| 4,909,156 | 3/1990 | Erickson | 105/359 |
| 4,917,266 | 4/1990 | Kellenberger et al. . | |
| 5,040,693 | 8/1991 | Podd, Sr. et al. . | |
| 5,076,710 | 12/1991 | Derby . | |
| 5,109,893 | 5/1992 | Derby . | |
| 5,152,735 | 10/1992 | Podd, Jr. et al. . | |
| 5,181,625 | 1/1993 | Podd, Sr. et al. . | |
| 5,193,710 | 3/1993 | Podd, Sr. et al. . | |
| 5,300,226 | 4/1994 | Erickson | 210/603 |

COLLAPSIBLE CONTAINER FOR HAULING BULK MATERIALS

This application is a continuation of co-pending U.S. Pat. application Ser. No. 08/233,111, entitled COLLAPSIBLE CONTAINER FOR HAULING BULK MATERIALS, filed 25 Apr. 1994, which is in turn a continuation-in-part of co-pending U.S. Pat. application Ser. No. 08/190,989, entitled CONTAINER AND METHOD FOR TRANSPORTING FINELY DIVIDED AND DRIED COAL, filed 3 Feb. 1994.

FIELD OF THE INVENTION

The invention generally relates to a container and method for transporting bulk materials in freight vehicles which would otherwise be unable to haul such mat The invention has particular utility in transporting fly-ash, sewage sludge and fly divided coal on trucks and in open-top rail cars.

BACKGROUND OF THE INVENTION

The cargo spaces in many freight hauling vehicles are specifically designed to carry a single type of cargo. Such vehicles, however, are only useful for hauling the type of cargo for which the were designed. It would be desirable, therefore, to provide a container that enables specific use freight vehicles to be used for hauling other types of loads without interfering with the vehicles' usefulness for hauling the type of cargo for which it was designed.

It would be desirable to provide a container that is also intermodal. The efficiency of a container is enhanced if it can be efficiently transferred from one type of freight vehicle to another without altering the freight vehicle or delaying the loading and unloading process. Such intermodal containers not only increase the usefulness of the containers, but they also increase the capabilities and efficiency of the freight vehicles.

Several problems must be resolved when intermodal containers are used to haul bulk materials such as fly-ash, finely divided or dried coal, or sewage sludge.

The intermodal containers must prevent the material from blowing out of the vehicle. This problem is especially acute when hauling materials with small particle sizes such as fly-ash or finely divided coal. The containers may need to prevent oxygen from contacting some of the materials to avoid adverse chemical reactions. This problem arises when hauling spontaneously combustible materials such as finely divided or dried coal. The containers may also need to protect the vehicle from the contents of the bulk material in order to avoid impairing the usefulness of the vehicle for performing the purpose for which it was designed. The problem arises when hauling sewage sludge in vehicles that cannot have such contamination in hauling their regular cargo.

Another problem facing such containers is that they cannot substantially interfere with the operation of hauling the material for which the vehicles were designed. More specifically, the containers should be capable of being quickly loaded and unloaded from a number of different types of freight vehicles so that the vehicles are still efficient for their intended use. Consequently, the containers must be easily connected to a lifting device and be able to withstand the forces of being lifted and suspended.

Various containers have been designed for converting the type of cargo that a freight vehicle may haul. U.S. Pat. No. 4,735,457 discloses a container that is an inflatable bag having its bottom attached to a rigid support platform. The bag is positioned in an erected condition to handle bulk material and moveable to a stored position near the roof of the cargo space to allow handling of piece goods.

The bags disclosed in U.S. Pat. No. 4,735,457 are not readily removable from the roof of the cargo space. U.S. Pat. No. 4,497,259 discloses a convertible freight car that operates either as a flatbed car for hauling lumber or the like, or a bulk storage freight car for items such as grain or the like. The freight car has a top flatbed assembly which is supported by a frame in a raised position, and from which a number of collapsible containers are supported. The containers disclosed in U.S. Pat. No. 4,497,259 are attached to the top flatbed assembly, and cannot be removed from the freight car.

Although current freight car conversion devices are functional for some uses, they do not provide a container that may transferred from one type of freight vehicle to another while also converting a single use vehicle into a multiple use vehicle. Additionally, current freight car conversion devices do not address providing a collapsible container capable of withstanding the focus of being loaded, unloaded and carried while containing several tons of material. Therefore, a need exists to provide such a container.

SUMMARY OF THE INVENTION

The present invention is a collapsible intermodal container for hauling certain bulk materials in freight vehicles designed for other uses. By intermodal, the container may be transferred from one type of freight vehicle to another without significantly delaying the freight vehicle or impairing the vehicle's usefulness for hauling the material for which it was designed.

The container includes a generally flexible barrier having an upper section and a lower section. The barrier defines a collapsible cavity in which bulk materials may be controlled during transportation so that they do not blow away or sully the freight vehicle. At least one port extends through the upper portion of the barrier, and it is through the at least one port that the bulk materials are passed into and out of the cavity. A removable cover, which is attachable to the periphery of the port, is received within the port to close the container after it has been filled. A lifting member is attached to the upper section of the barrier. The lifting member may have a fitting for engaging a lifting bar of a crane and a flange for engaging the side wall of a rail car. A strap is attached to the lifting member and the barrier for providing support to the barrier as it is being lifted and suspended as it is loaded or unloaded from a freight vehicle. An inversion ring is attached to the lower section of the barrier for holding the container in placed as it is inverted when the container is tipped upside down to discharged the materials from the cavity.

These and other features of the invention will become more apparent upon reference to the following description of the preferred embodiment of the invention, and in particular, upon referring to the drawings.

DETAILED DESCRIPTION OF THE PREFERRED EMBODIMENT OF THE INVENTION

Figure 1:
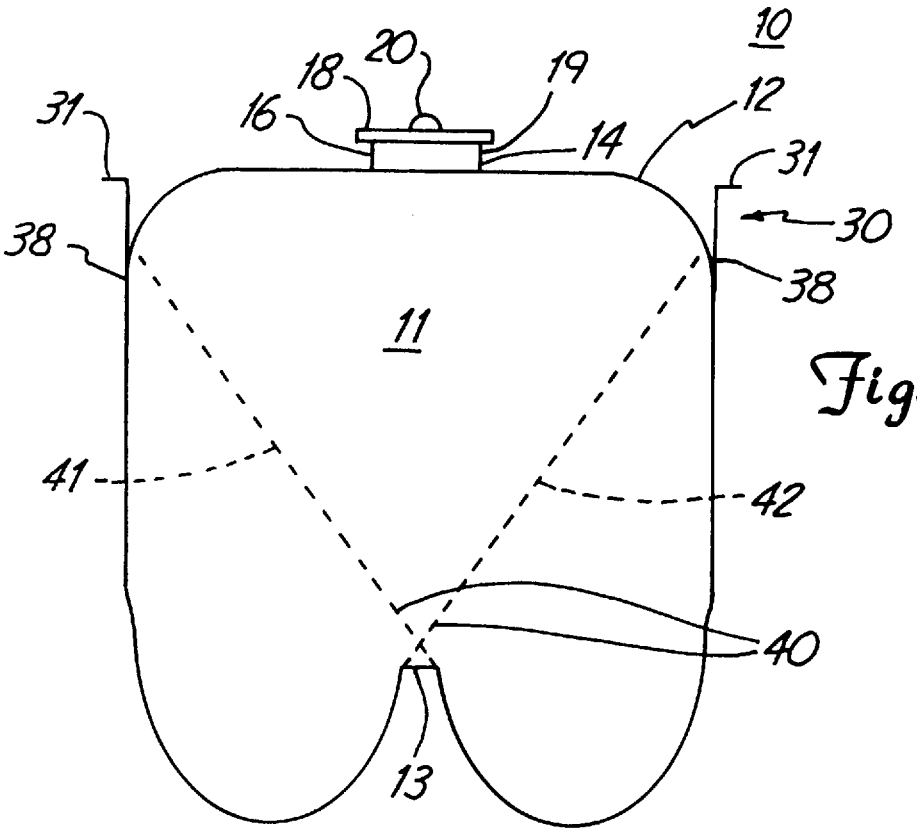
FIG. 1 is a front view of a container for transporting a flowable material in accordance with the invention.

FIG. 1 depicts the container 10 configured to define a cavity 11 having a double-bottom for transporting a flowable material. The container 10 is well suited for transporting a wide variety of flowable materials. Fly ash, a by-product of burning coal that is useful as a cement feed stock, is one such flowable material. Other such flowable materials include industrial chemicals and fuels and the like. In one embodiment, described in detail below, the fuel is finely divided coal.

The container 10 may have a barrier 12 which is made from a generally flexible material that is substantially impermeable to oxygen and substantially puncture resistant. The barrier 12 may be made from rubber, an aromatic polyamide fiber such as Kevlar™, nitrylvinyl nylon cloth, or other materials of the group that are relatively strong, wear resistant, and have a low permeability to oxygen. In one embodiment, the barrier may be a composite of such materials and may, for example, use Kevlar™ in those areas of the bladder which will be in direct contact with a rail car during transportation to provide improved strength, toughness and wear resistance in those areas where such characteristics are most needed. In a preferred embodiment, the barrier may be made from nitrylvinyl nylon cloth.

At least one port 14 is positioned in the barrier 12. A flowable material, such as finely divided coal, may be passed through the port 14. In a preferred embodiment, the port 14 may be positioned on the barrier 12 generally at the top of the container 10. The port 14 may have a coupling 16 sealingly connected to the barrier 12. The coupling 16 may be generally self-sealing and capable of substantially preventing oxygen from entering the cavity 11 while a flowable material is passed through the port 14. In a preferred embodiment, aviation fuel couplings such as dog-ear quick couplings or self-sealing couplings for dry powder handling may be used. One such self-sealing coupling is manufactured by Dixon Valve & Coupling, Co. A cap 18 may be sealingly connected to the coupling 16 to ensure that the port 14 is substantially sealed. A lock 19 may be positioned between the port 14 and the cap 18 to prevent unauthorized entry into the containers. A hoisting means 20 may be connected to the cap 18. As will be discussed later, the hoisting means 20 is not the exclusive means to lift the container 10.

The barrier 12 may be supported and configured to create different cavity shapes by an adjustable infrastructure. The adjustable infrastructure may include an external harness 30 and an internal supports 40. Referring now to FIGS. 1–4, the external harness 30 includes a number of hooks 31 that are preferably arranged in opposing pairs so that a first hook engages the left side wall 57 and a second hook engages the right side wall 58 in a position generally across from the first hook. Each hook 31 may have a pad 32 attached to the surface of the hook that engages the top of the rail car wall 58. A tether 36 may be connected to the hook 31 and the barrier 12. In a preferred embodiment, the hook 31 may be connected to one or more supports 38 that are attached to the side of the barrier 12. The external harness 30 supports the barrier 12 and reduces any movement of the container 10 within the rail car, thereby stabilizing the container.

Figure 5:
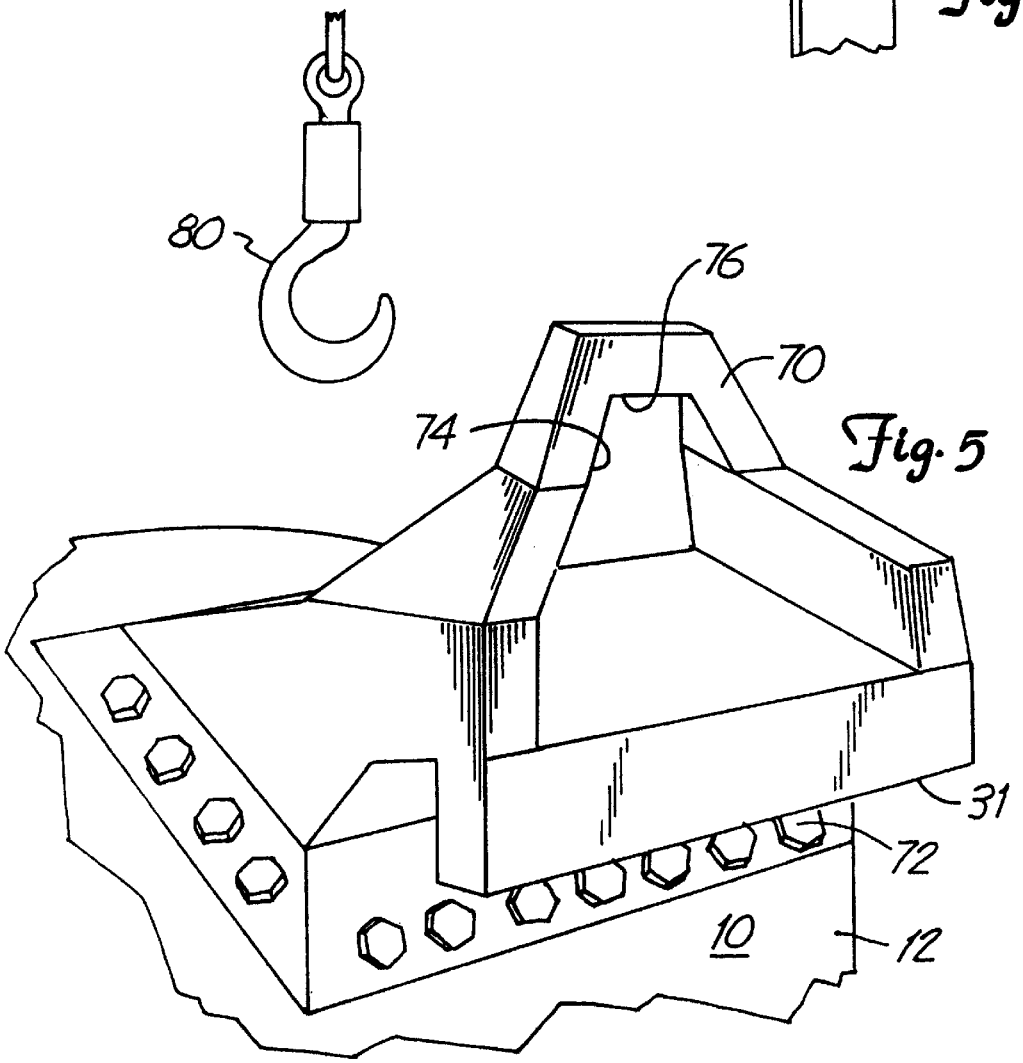
FIG. 5 is an elevational view of an embodiment of the container in accordance with the invention having a lifting catch.
Figure 6:
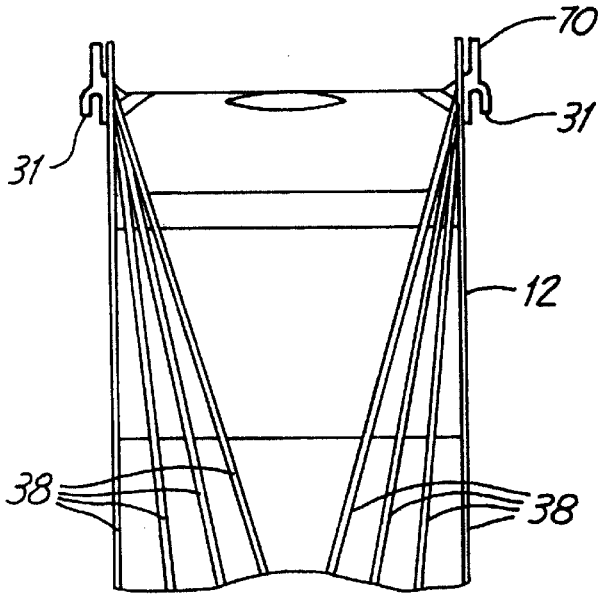
FIG. 6 is a front view of a container of the invention having a lifting catch.
Figure 7:
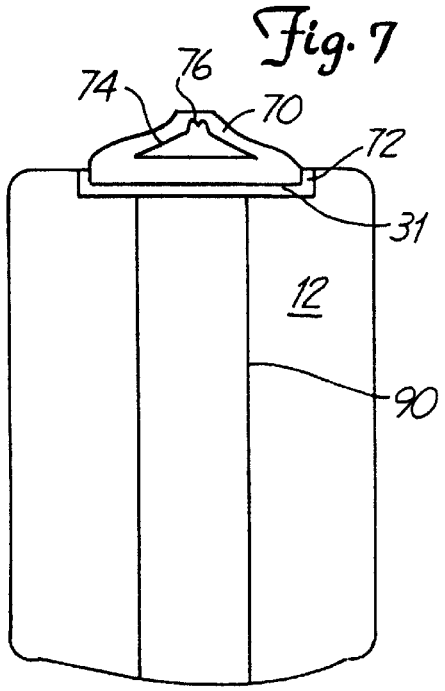
FIG. 7 is a side view of a container of the invention having a lifting catch.

FIGS. 5–7 depict an embodiment of the invention having a lifting catch 70 for easier and faster unloading of the container 10. The lifting catch 70 may have a substantially pyramidal shape and an inner surface 74 defining an opening through the pyramid. A hook 80 or some other lifting means on a hoist engages the lifting catch 70 anywhere on the inner surface 74. As the hook 80 is raised, it is automatically contained at the apex 76 of the lifting catch 70 making it easier and faster to unload a container 10.

It will be appreciated that the lifting catch 70 of the present invention may be integral with a hook 31 as shown in FIGS. 5–7, or it may be connected directly to the barrier 12 separately from the hook 31 (not shown). It will also be appreciated that the lifting catch 70 may have other shapes, such as semicircles, that are well-suited for the purposes of providing a larger target and automatically centering the hoisting means to the load.

Figure 9:
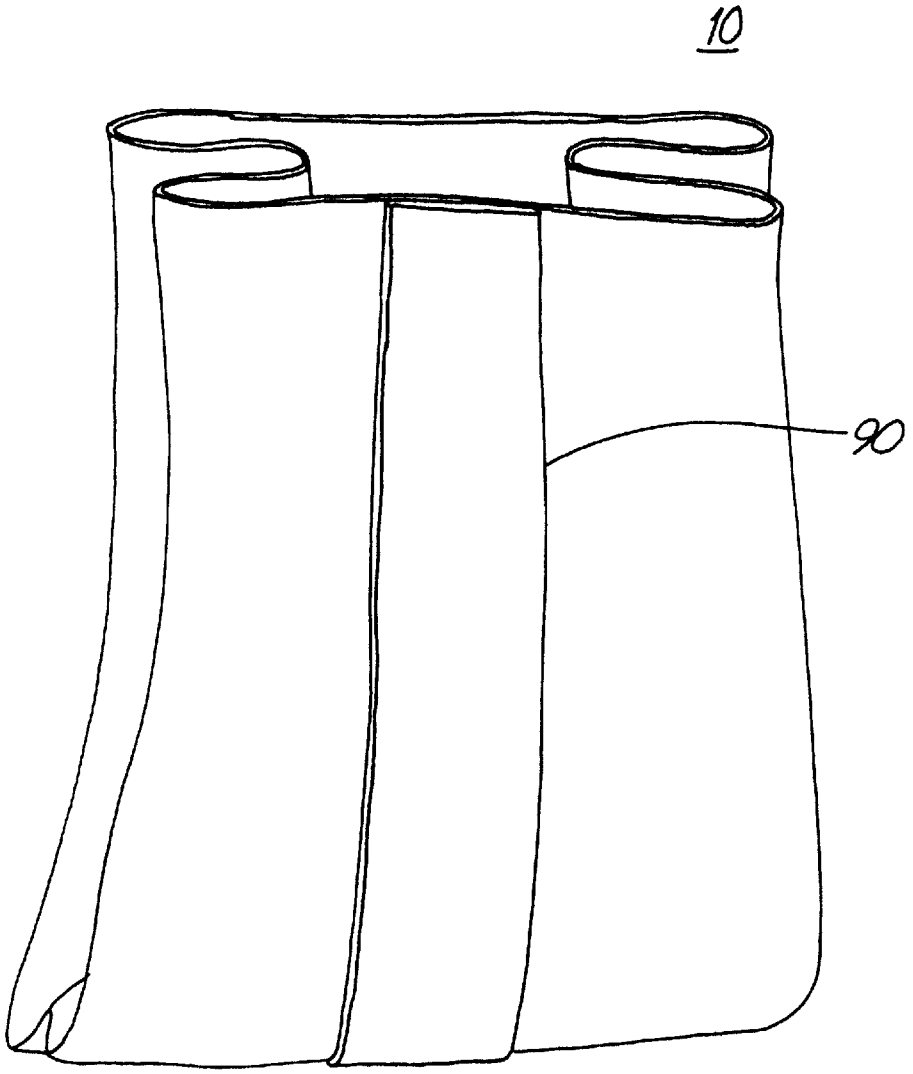
FIG. 9 is a perspective view of a container of the invention folded together.

FIG. 7 depicts an embodiment of the invention having a protective sash 90 externally attached to the barrier 12 for protecting the barrier from tears caused by bolts and other rough edges. The sash 90 is a puncture resistant material, and at least one sash is positioned on each surface of the barrier 12 facing the adjacent side walls of a rail car. The sash may be made from fairly rigid plastics, cordura, or the like. Generally, the sash may be about 20 to 24 inches wide and extend down the length of the side of the barrier 12. Other sizes and materials, however, may be used depending upon the specific transportation vehicles being used. The container 10 may be folded flat by moving the sashes on opposite sides of the container towards one another as shown in FIG. 9.

Figure 8:
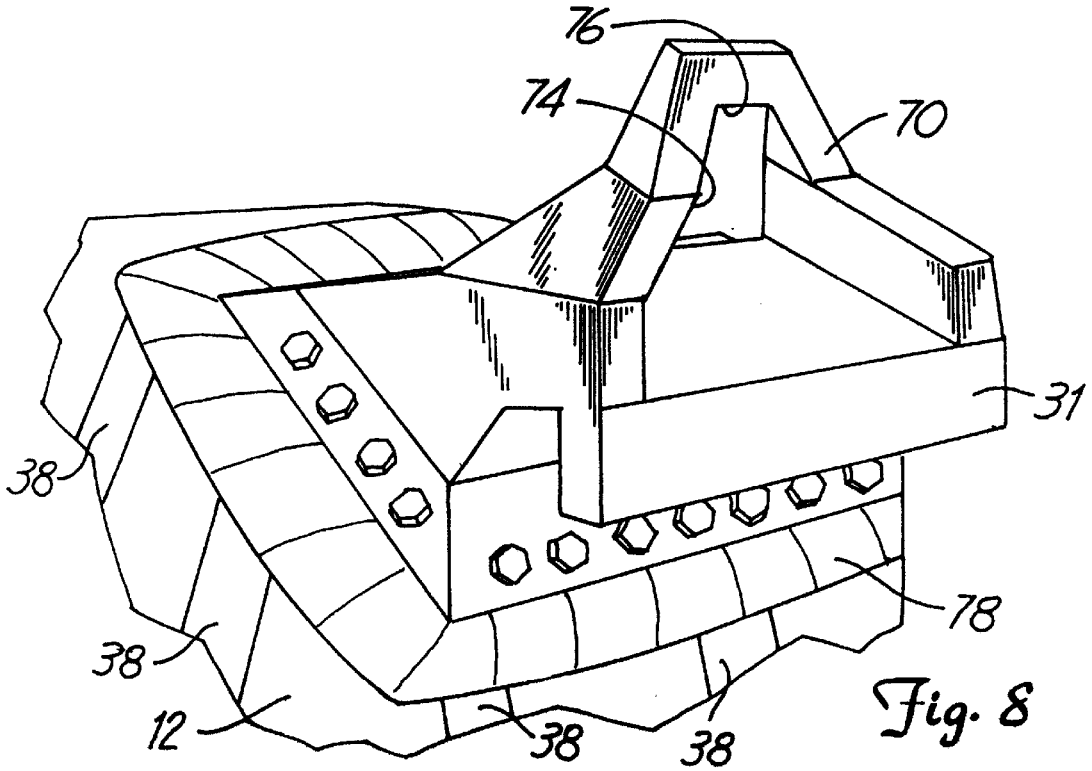
FIG. 8 is an elevational view of a container of the invention having a reinforced lifting catch.

FIG. 8 depicts a preferred embodiment of the invention in which the lifting catch 70 is integral with the hook 31, and the catch/hook assembly is connected to a reinforced section 78 of barrier 12. The supports 38 may be attached to the barrier 12 and the reinforced section 78 to provide support for the barrier 12 when it is filled with a flowable material.

Referring to FIG. 1, the container may be configured so that the cavity 11 conforms to the center sill of a rail car by adjusting the internal supports 40. In a preferred embodiment, the internal support 40 includes adjustable links 41 and 42. The links 41 and 42 may be generally adjustable lengthwise. Link 41 may be connected to the barrier 12 on its upper end below the point on the barrier in which a hook 31 or its corresponding siding 38 are connected. Link 42 may be connected to another hook 31 on the opposite side of the container at about the same location. The links 41 and 42 may then be connected to the lower side of the barrier 12 at their lower ends. In a preferred embodiment, the links 41 and 42 cross over each other and are connected to the internal surface of the barrier 12 along opposite sides of a wear guard 13. The links 41 and 42 may be straps, cables, ropes, chains, belts, or the like.

In alternative embodiment (not shown), the infrastructure including an external harness and internal support may be made from rigid members. The external harness may have hooks arranged in opposing pairs for engaging substantially the same relative positions of opposing side walls of an open-top rail car. Each hook may be attached to a siding member that extends down the side of the barrier. Each siding member may be hingedly connected to a plurality of rigid members that are hingedly and serially linked across the bottom of the container. The internal support may include a number of adjustable links. Each adjustable link may be connected to the barrier at its upper end, and to a point on the barrier adjacent to one of the hinges connecting the rigid members across the bottom of the barrier at its lower end.

Figure 2:
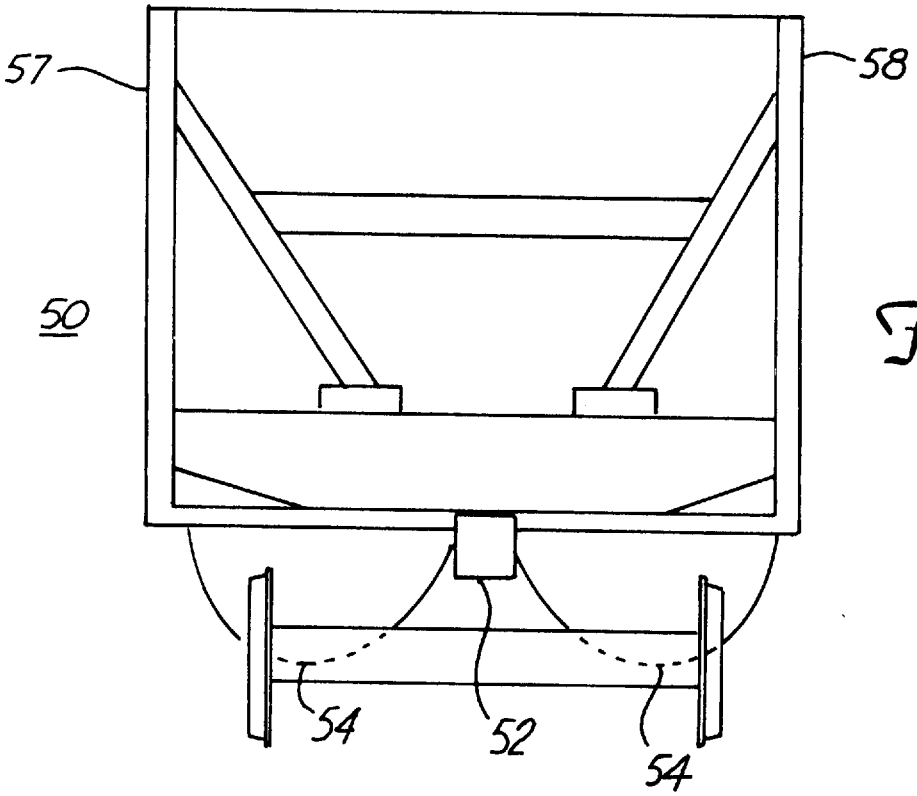
FIG. 2 is a front view of a double-bottom rail car currently used for hauling bulk coal.
Figure 3:
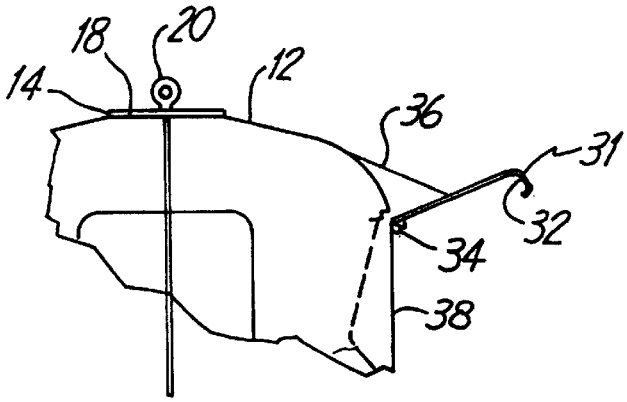
FIG. 3 is a detailed view of an external harness of a container in accordance with the invention.
Figure 4:
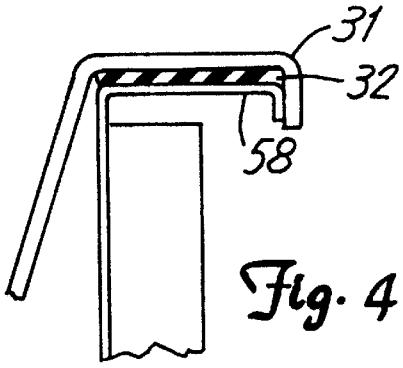
FIG. 4 is a detailed view of a hook in accordance with the invention.

FIGS. 1 and 2 depict a preferred embodiment in which the links 41 and 42 are adjusted to form a double-bottom. After a container 10 has been filled, it is hoisted into a rail car 50. The hooks 31 engage the sidewalls 57 and 58 in opposing pairs along the same respective positions of the side walls so that the container 10 conforms to the bottom 54 and the center sill 52 of the rail car. Container 10 substantially prevents concentrating forces on the center sill 52, and side walls 57 and 58, simulating the forces exhibited by bulk coal.

A method of the present invention using container 10 involves removing substantially all of the oxygen from the cavity. Oxygen may be removed from the cavity by either collapsing the container, drawing a vacuum in the cavity, or replacing the oxygen with a substantially anaerobic, non-reactive gas. One such anaerobic gas especially plentiful near mining operations is carbon dioxide. In a preferred method, the oxygen may be removed from the cavity of the container by other procedures such as completely collapsing the cavity 11 so that it has virtually zero volume.

Another step in a method is to adjust the internal supports 40 of the container 10 to conform to a shape of a rail car. In addition to the double-bottom shape previously discussed, a container may also be configured into a V-shape to conform to the bottom of a hopper car. It will be appreciated that the shape of the cavity is not limited to a double bottom or V-shape since the adjustable link can be adjusted to create any number of shapes.

After substantially all of the oxygen has been removed from the cavity, the container 10 is filled with a flowable material. In a preferred embodiment, the container 10 is filled with finely divided coal at a site where the coal is processed by micronization or pulverization. Finely divided coal, which generally has a particle size equal to about one-half the diameter of a human hair, has a powder-like consistency. Finely divided coal may be passed into the cavity of the container by fluidizing the coal with a substantially anaerobic gas. After the coal is fluidized, it can be passed into the container by pumping it in a manner similar to any other fluid. Alternatively, another embodiment of the invention mechanically actuates the coal into the container by auguring, vibrating, or "sound horn" devices well known in the art of handling dry powders.

In an alternative embodiment, the container is filled to a predetermined volume that is less than the total volume of the container. A completely full container is turgid and unable to flow around obstacles. As a result, completely full containers do not conform to the center sill of a rail car unless the internal supports are adjusted nearly perfectly. In this alternative embodiment, the predetermined volume is 50 to 90 percent of the total volume of the container, and preferably 70 to 80 percent. This alternative embodiment allows the container to adapt to the configuration of the center sill without having to readjust the internal supports for every rail car, and even allows containers without internal supports to conform to the floor of existing coal hauling rail cars.

After the container has been filled, either completely full or to a predetermined volume, the source of flowable material is disconnected and the coupling 16 may automatically seal the container to substantially prevent introducing oxygen to the flowable material. A cap 18 may be sealingly connected to the port 14 and coupling 16 to further ensure that the flowable material is not exposed to oxygen. In a preferred embodiment, a lock 19 is activated to prevent unauthorized access into the container.

The filled container is then loaded into a coal hauling rail car. A filled container may be hoisted into a rail car using a crane or the like. The hoist may act against a lifting catch 70 attached to either the hooks or the barrier, or a hoisting means on the cap, or a combination thereof. After the filled container is raised, it is positioned in the rail car as previously discussed to avoid over-stressing the internal cross-members 52 of the rail car.

After the filled containers are loaded into the rail cars, they are hauled to a location using the flowable material. The containers may be either emptied as they sit on the rail cars, or hoisted out of the rail cars and emptied later. In a preferred embodiment, the containers are first hoisted out of the rail cars and then emptied. In doing so, the rail cars may move more quickly resulting in lower transportation cost. Also, the containers of the present invention inherently act as a storage means. Thus, the utilities do not need to make extensive investments in fixed storage facilities that are substantially oxygen free. The containers may be emptied in the same manner in which they were filled. It will be appreciated that a single container may be filled using one filling process, and emptied using yet another process.

Although the container and method of the present invention have been described as transporting finely divided coal, it will be appreciated that the term "finely divided coal" encompasses dried coal and/or lignite. It is also to be appreciated that the present invention is especially well suited for hauling other substances. Trains offer a superior mode of transporting chemicals, fuel or the like because they are more economical and safer than other modes of land transportation. Additionally, large quantities of chemicals and fuels must be transported to mines that are often situated in remote locations. The container and method of the present invention may be used to safely and economically haul substances such as chemicals and fuel to mines on the backhaul leg of a train route.

FIGS. 10–17 depict another embodiment of the invention for hauling materials in freight vehicles designed for other uses. The container 110 in this embodiment may also be transferred from one type of freight vehicle to another without significantly delaying the freight vehicle or impairing the vehicle's usefulness for hauling the material for which it was designed.

Figure 10:
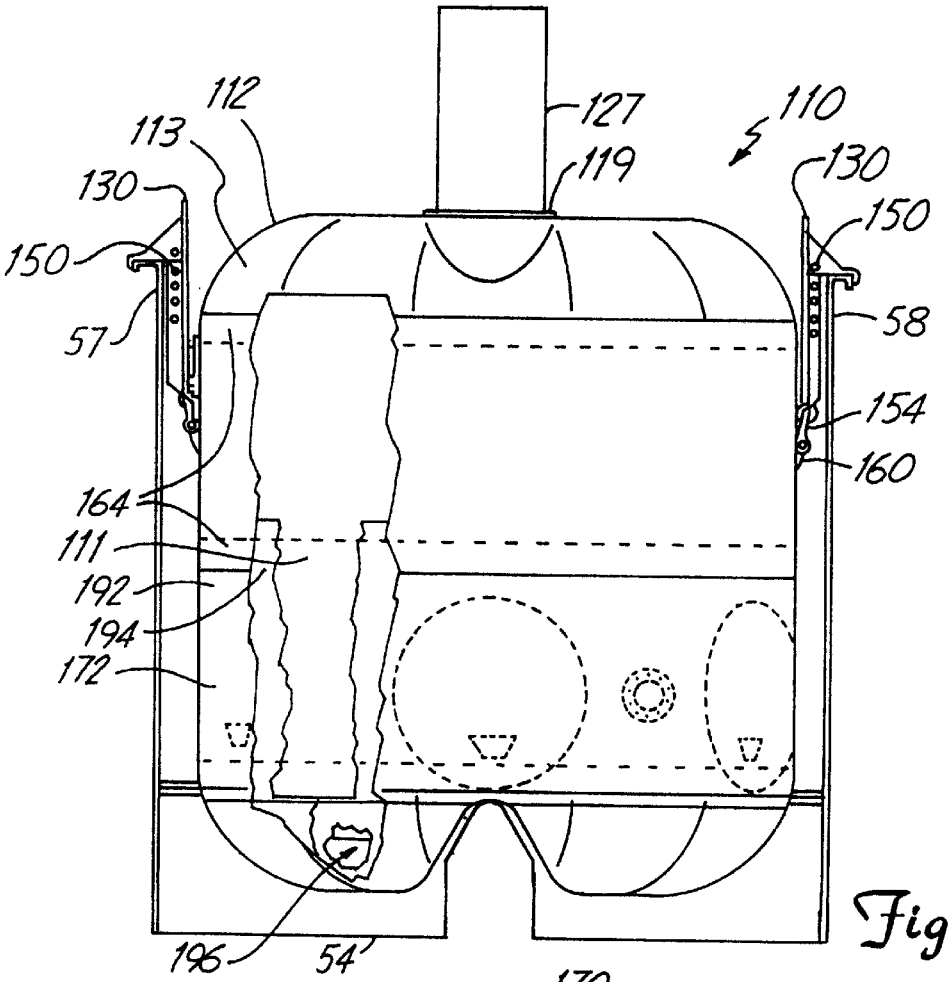
FIG. 10 is a front view of an embodiment of the container of the invention.

FIG. 10 is a cut-away view showing the front of a container 110 positioned within a rail car 50. The container 110 includes a barrier 112 configured to define a cavity 111 for hauling a bulk material. The barrier 112 may be a generally flexible material that is the same as that used to make the barrier 12 of the previously described container 10. The container barrier 112 may be made from two plies of material, an outer ply 192 and an inner ply 194. A third reinforcement ply 196 of material may be positioned adjacent the inner ply 194 along the lower section of the cavity 111 to enhance the durability of the container 110. The plies 192, 194, 196 may be bonded together by well known processes in the art.

The container 110 may include a lifting member 130 attached to barrier 112. Each lifting member may have an adjustable arm 150 for engaging a sidewall of the rail car 50. Alternatively, the container 110 may include a lifting member 130 attached to each side of the container. In the preferred embodiment, the lifting members 130 engage the top of the side walls 57, 58 of the rail car 50, respectively, so that the side walls of the rail car support part of the weight of the container. The remaining weight of the container 110 may be supported by the center sill 52 and the floor 54 of the rail car 50.

The container 110 may also include a ring 170 attached to the lower section of the container for securing the container 110 as it is inverted upside-down. A retaining device (not shown) may engage the ring so that the container 110 may be inverted to empty the contents from the cavity 111. A reinforcement patch 172 having a ring mount 171 may be positioned between the inner ply 194 and the outer ply 192. In a one embodiment, the patch 172 is made from nylon and positioned between the plies before the plies are assembled and bonded together. As such, the patch 172 may meld with the plies as they are bonded to become integral with the barrier 112. The ring mount 171 may be a strap which is attached to the patch and woven back over itself to form a loop, or it may be integral with the patch 172 in the form of loop. The ring 170 may have a trapezoidal shape and be attached to the ring mount 171 by positioning the base of the trapezoid into the loop of the ring mount 171. The shape of the ring 171 is not limited to being trapezoidal, and may be circular, triangular or any other shape. Such a ring may be engaged by a hook or the like (not shown) carried by the retaining means.

Figure 11A:
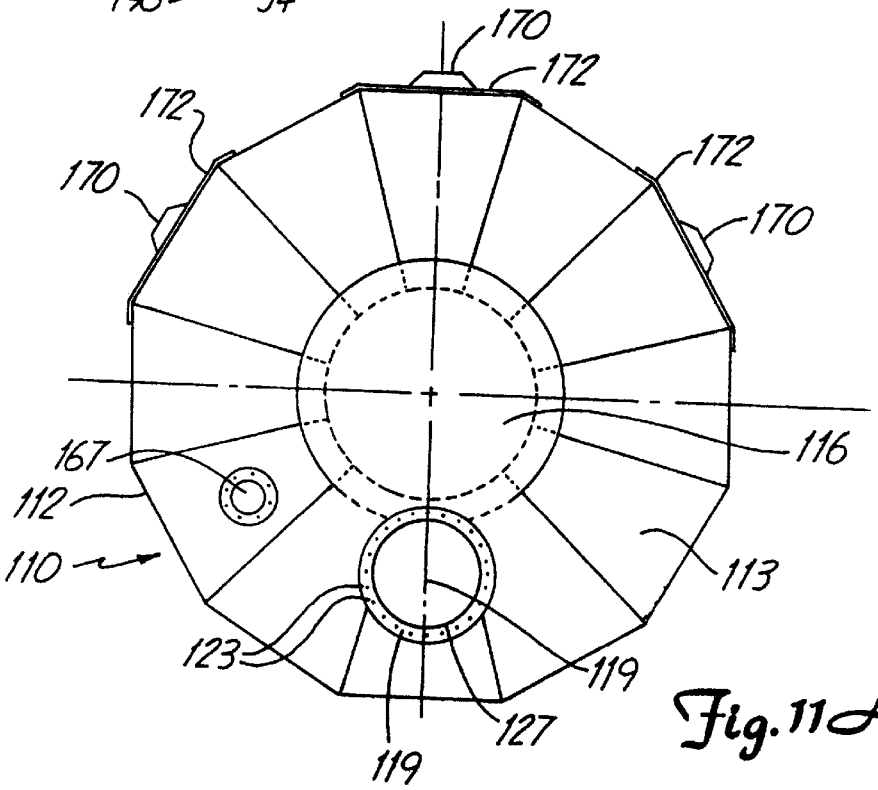
FIG. 11 is a top view of the container of FIG. 10.
Figure 11B:
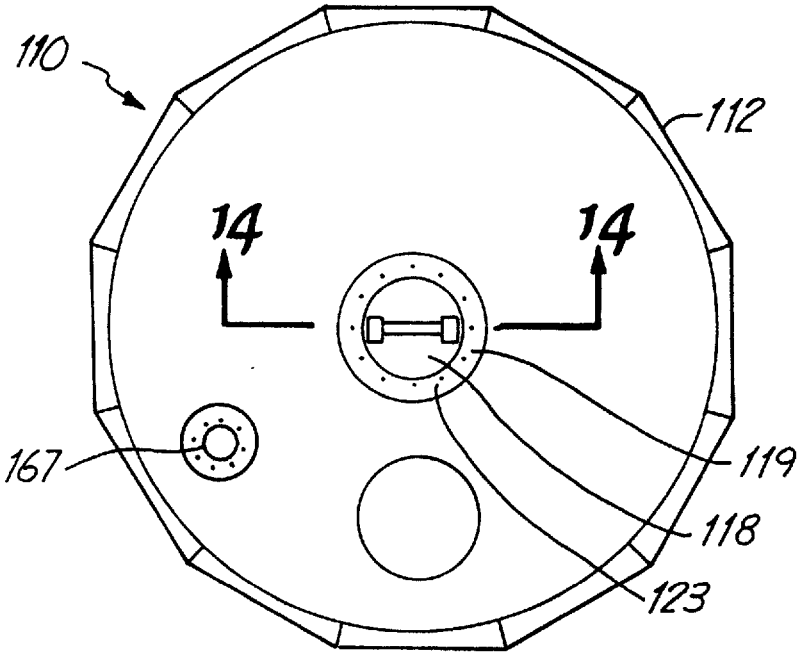

Referring to FIGS. 10, 11A and 11B, the container 110 includes at least one port 114 and may also include a top opening 167. The port 114 may be positioned off center as shown in FIG. 11 or it may be positioned in the center of the top as shown in FIG. 11B. The port 114 is the main orifice in the barrier 112 through which bulk materials are passed to either fill or empty the container 110. The port 114 may be about nineteen inches in diameter for use with dry, small particle size materials such as fly-ash or dried coal, or it may be as large as six feet in diameter for use with sewage sludge, FGD scrubber sludge or other materials having a low viscosity. The size and shape of the port 114 are not limiting factors of the invention and may be made any size or shape to accommodate the specific use. The top opening 167 may be positioned in the upper section of the container 110 for releasing excess gas in the cavity 111 during the filling process, transportation and storage of bulk materials.

A removable sleeve 127 may be attached to the container 110 at the port 114 to contain the bulk materials as the container 110 is being filled or emptied. The sleeve 127 operates by attaching the upper end of the sleeve 127 to a filling pipe or discharge (not shown) at a point partially up the pipe before the bulk materials are passed through the pipe. After the container is filled, the upper end of the sleeve 127 may be tied off to the container, or the sleeve may be simply removed from the port 114. Similarly, the sleeve 127 may remain attached to the port 114 as the container 110 is inverted to empty the bulk materials, or it may be removed prior to inverting the container. The sleeve 127 may be made from a flexible material such as cordura, or other materials that are durable, flexible and substantially impermeable to materials having a particle size of 0.002 inches or more.

Figure 13:
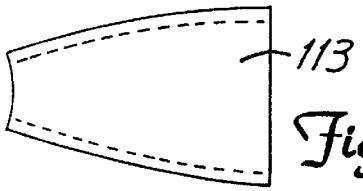
FIG. 13 is a detailed view of a top panel of the barrier of the present invention.

The outer ply 192 on the uppermost section of the container 110 may be configured of a plurality of triangular panels 113 and a circular center panel 116. FIG. 13 shows a triangular panel 113 with the phantom lines indicating the amount of overlap of each panel with an adjacent panel. In an alternative embodiment, the outer ply on the uppermost section of the container may be integral with the rest of the outer ply 192 (not shown), or it may be a separate single piece of outer ply material (not shown).

Figure 12:
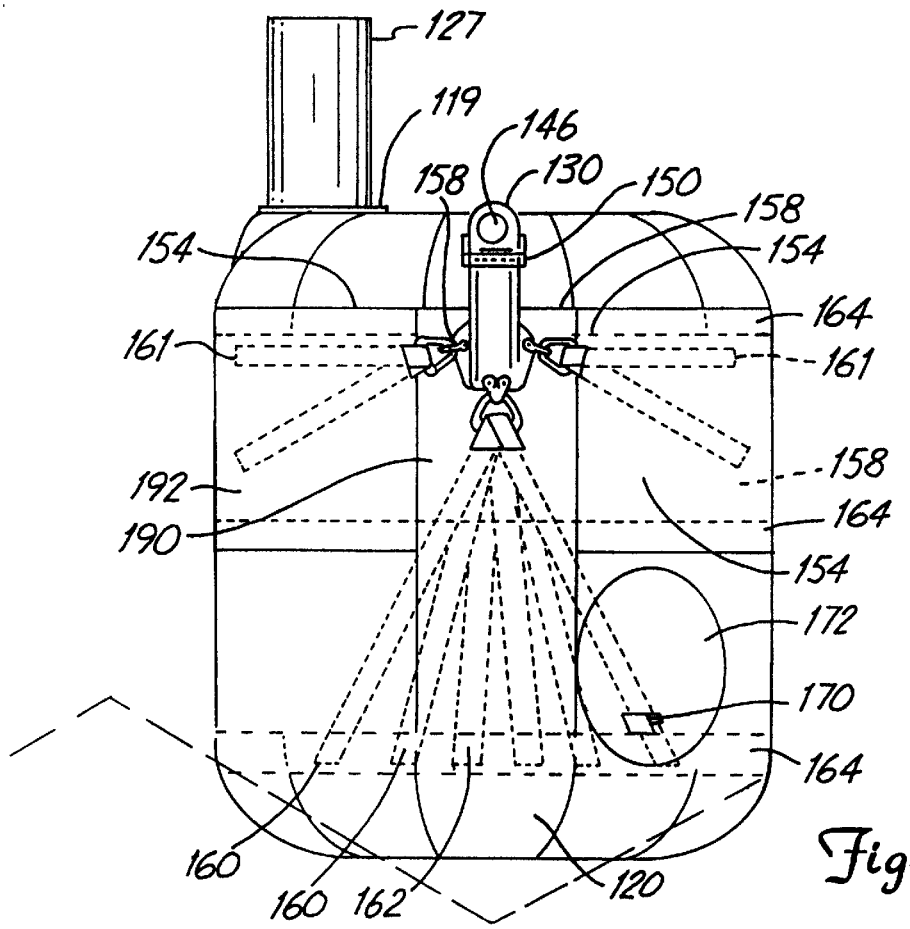
FIG. 12 is a side view of the container of FIG. 10.

Referring to FIG. 12, an abrasion and puncture resistant wear guard 190 is positioned on the lower section and at least a portion of the sidewall of the container 110. The wear guard 190 may be a soft polymer or a fabric that is adhered to the exterior surface of the outer ply 192 at locations where the container 110 contacts the adjacent side walls, center sill and floor of a rail car or other freight vehicle (not shown). Suitable fabric materials for forming this wear guard 190 may also be the same as that of the rest of the barrier, e.g. rubber, nylon nitrylvinyl nylon or Kevlar. The wear guard 190 protects the container 110 so that it can withstand substantial abuse as it is lifted into and out of rail cars, and during the transport of materials in cold weather when it may freeze to the freight vehicle. Even if the wear guard is formed of the same material as the rest of the barrier, the additional ply or plies of material in the wear guard can greatly prolong the life of the container.

The lifting member 130 is attached to the side of the container 110 and a number of straps 160, 161, 162 are attached thereto. The lifting member 130 may interface with a crane as shown in FIGS. 20A–20D. Each strap is folded over at about its mid-point, and the ends are inserted through a slit in the outer ply 192 so that the ends are positioned between the outer ply 192 and the inner ply 194. The ends of the straps positioned between the plies are secured to the barrier 112 as the plies are bonded together. (one suitable process for forming a barrier of the invention, including a process for bonding the straps in the barrier, is outlined below.) Only the folded part of the strap is exposed on the exterior of the outer ply 192. A horizontal strap 161 may be positioned in the upper section of the barrier 112 and connected to the lifting member 130 by a large shackle 154 engaging the folded part of the strap. The horizontal strap 161 provides radial support and distributes some of the forces incurred during lifting to the front sides of the container 110. A narrow vertical strap 160 and/or a wide vertical strap 162 may be positioned generally vertically along the side wall of the barrier 112 and similarly connected to the lifting member 130. The vertical straps 160 and/or 162 support the barrier during transportation in a rail car and when the container is being lifted from a freight vehicle.

In a preferred embodiment, a web of straps is used to support the barriers. The web includes at least one horizontal strap 161 positioned on each side of the lifting member 130, and two narrow vertical straps 160 with one wide vertical strap 162 positioned below the lifting member 130. The vertical straps 160, 162 may extend underneath the container 110 to provide additional support. The web and the barrier 112 may have a lifting capacity of approximately thirty tons, but other lifting capacities may be achieved by varying the number, size, materials and position of the straps.

The container 110 may also include a separate radial support band 164 around the circumference of the barrier 112. In one embodiment, a first radial band 164 may be positioned at the upper section, a second radial band may be positioned at the mid-section and a third radial band 164 may be positioned at the lower section of the container 110. The radial bands 164 may be positioned between the plies 192, 194 and adhered to the barrier 112 in the same manner as the described above for the straps 160, 161, 162. Alternatively, the radial bands may be positioned on the exterior surface of the outer ply 192 and attached to the barrier 112 by an adhesive or sewed to the barrier 112.

In general, the straps and bands may be made from any suitable material having sufficient tensile strength and flexibility. For example, in one embodiment, the straps and bands are made from a strong, flexible nylon fabric. It will be appreciated that the straps may actually be chains, wire rope, wire mesh or the like, depending upon the use of the container 110.

Figure 15:
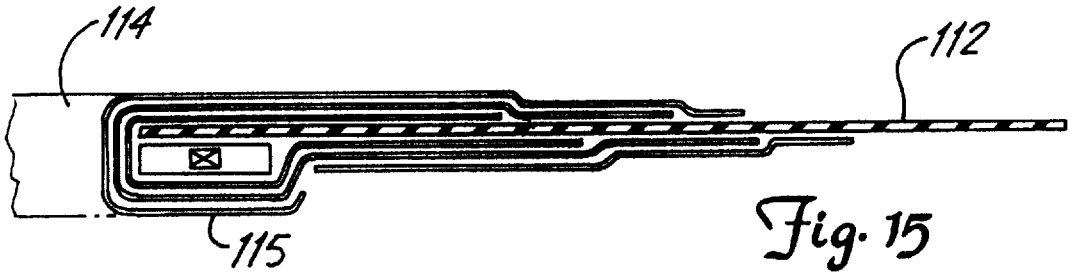
FIG. 15 is a cross-sectional view of the periphery of the port of the invention.
Figure 14:
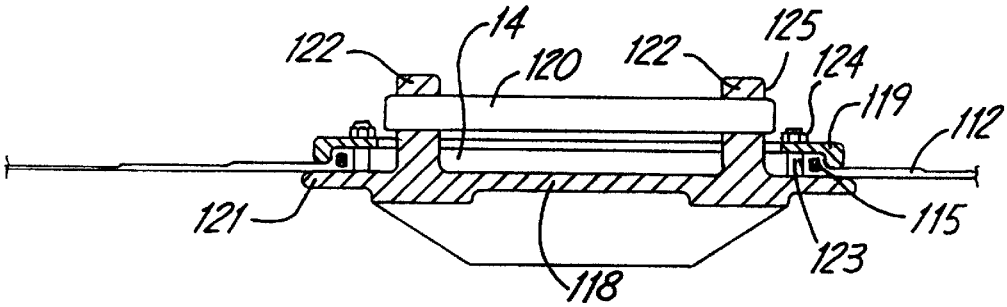
FIG. 14 is a cross-sectional view of port and cover of the invention.

FIG. 14 depicts a cover 118 of the present invention received within the port 114. The cover 118 may include two flanges 122 and an annular shoulder 121 from which a plurality of threaded studs 123 extend upwardly. A handle 120 may be positioned in holes 125 in the flanges 122. The cover 118 is used to close the port 114 by positioning the annular shoulder 121 adjacent the interior surface of the barrier 112, and clamping the periphery 115 of the port between a retaining ring 119 and the annular shoulder 121. The periphery 115 may be clamped between the retaining ring 119 and the annular shoulder 121 by threadedly engaging a nut 124 to each of the studs 123. It will be appreciated that the cover assembly depicted in FIG. 14 also may be used to close the openings 166, 167. FIG. 15 depicts a cross section of the periphery 115 of the port 114.

The bulk materials in the container 110 may be gravitationally discharged by removing the cover 118 and inverting the container so that the port 114 is positioned below at least some of the bulk materials in the cavity 111. In one embodiment, the container 110 is placed on a mechanical inverter (not shown) and the rings 170 are secured to a retaining means (not shown) attached to the inverter. The rings 170 will hold the container 110 onto the mechanical inverter as the container is flipped upside-down, allowing the bulk materials to flow out of the container. If the nature of the material being handled in the container 110 so dictates (e.g. when a small particle size material is being hauled), gases or air may be used to fluidize the contents of the container when it is inverted.

Figure 16:
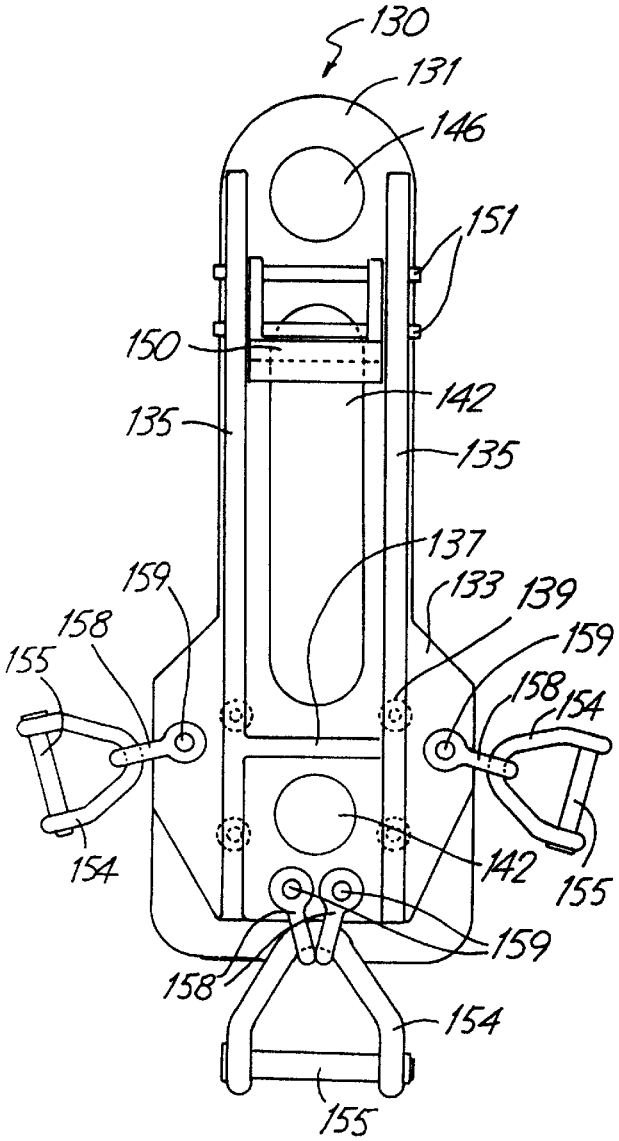
FIG. 16 is a detailed front view of the an embodiment of the lifting member in accordance with the invention.
Figure 17:
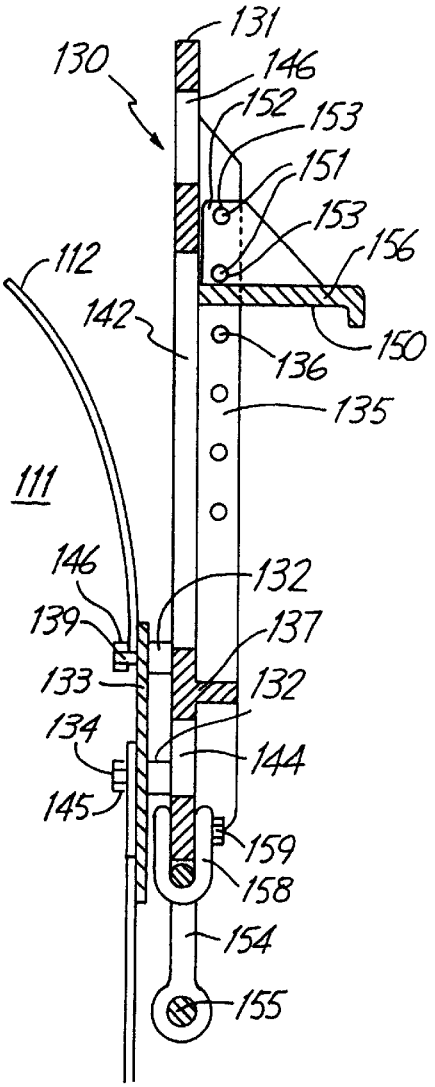
FIG. 17 is a cross-sectional view of the lifting member of FIG. 16.

Referring to FIGS. 16 and 17, the lifting member 130 may include a base plate 133 connected to a main plate 131 by a number of legs 132. The lifting member 130 may be attached to the barrier 112 by any suitable means and may be either permanently attached to the barrier or releasably attached thereto. In one embodiment wherein the lifting member 130 is releasably secured to the barrier, a number of threaded studs 139 extending from the base plate 133 through the barrier 112 and threadedly engaging corresponding nuts 140. The lifting member 130 may alternatively be essentially permanently attached to the barrier by an adhesive when the container 110 is used for hauling lighter loads; it is not expected that a mere adhesive connection will be strong enough to handle particularly heavy loads. In another embodiment, the lifting member 130 is readily detachable from the barrier, being attached only to straps such as straps 160, 161, 162 or the like rather than to the wall of the barrier itself.

The plate 131 may be generally elongated so that the upper portion of the plate extends above the top of the container 110 to provide an accessible target for a crane operator. An elongated brace 135 with a plurality of holes 136 may be positioned along each edge of the plate 131, and a cross brace 137 may be positioned transversely between the elongated braces 135. An adjustable arm 150 having a base 152 with holes 153 may be positioned between the elongated braces 135 and adjustably attached to the elongated braces by a number of pins 151 extending through the holes 153 and 136. An L-shaped plate 156 may be attached to the base 152 for engaging the top surface of a side wall 57, 58 of a rail car, as shown in FIG. 10.

A number of small shackles 158 may be attached to lower section of the main plate 131 by threaded pins 159, and large shackles 154 may carried by the small shackles 158. In a preferred embodiment, a small shackle 158 is attached to each side of the main plate 131 and two small shackles are attached to the lowermost portion of the main plate 131. A large shackle 154 is attached to each small shackle 158 on the sides, and a single large shackle 154 is attached to the two small shackles 158 on the lowermost portion. The straps 160, 161, 162 may be attached to the large shackles 154 as shown in FIG. 12.

The lifting member 131 may be made from steel, aluminum or any other material that can support a significant amount of weight. The lifting member is designed to be a "pick point" which can be easily engaged with a crane for quick loading and unloading of the container 110, while also providing the necessary support when connected to the web of straps so that large loads may be lifted in a collapsible container made from flexible material. It will be appreciated that other lifting members may be designed to work with container 110 so long as the lifting member provides the necessary pick point and support.

Referring to FIGS. 16, 17 and 18, the plate 131 may include a fitting 146 positioned on the upper portion of the plate 131 for receiving mating fitting 183 carried by a lifting bar 175. In one embodiment, the fitting 146 may be a hole and the mating fitting 183 may be a pin. Alternatively, the fitting 146 may be a pin (not shown) and the mating fitting 183 may be a hole (not shown). Other suitable fitting combinations will be readily apparent to one skilled in the art.

The lifting bar 175 may include a housing 176 which carries opposing actuators 177 connected to rods 179. The actuators may be hydraulic or pneumatic cylinders, or any other means that can reciprocally move the rods 179 between a retracted position and an extended position along the elongated axis of the housing 176. An arm 181 carrying a mating fitting 183 may downwardly depend from each rod 179.

Figure 18A:
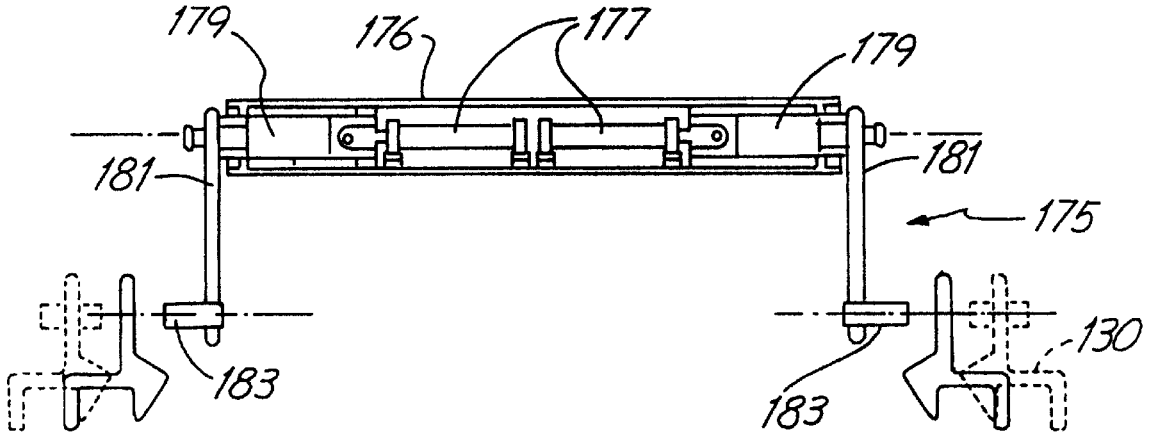
FIGS. 18A-18B are a cut-away view of lifting bars in accordance with the present invention.
Figures 20A, 20B, 20C:
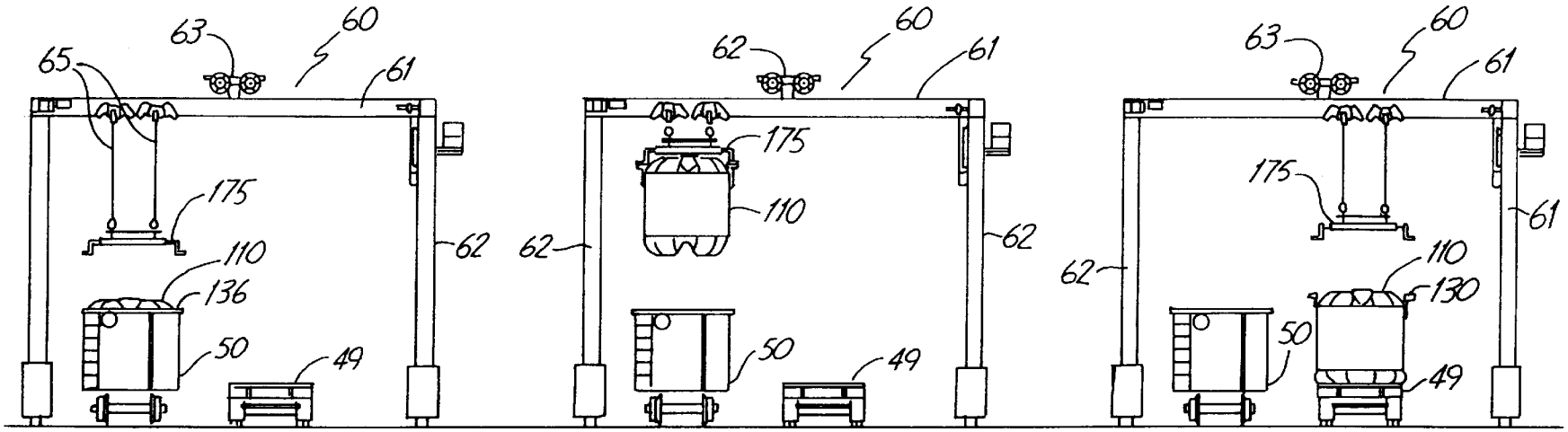
FIGS. 20A-20D depict a container of the invention being unloaded from a rail car and loaded onto a trailer.
Figure 20D:
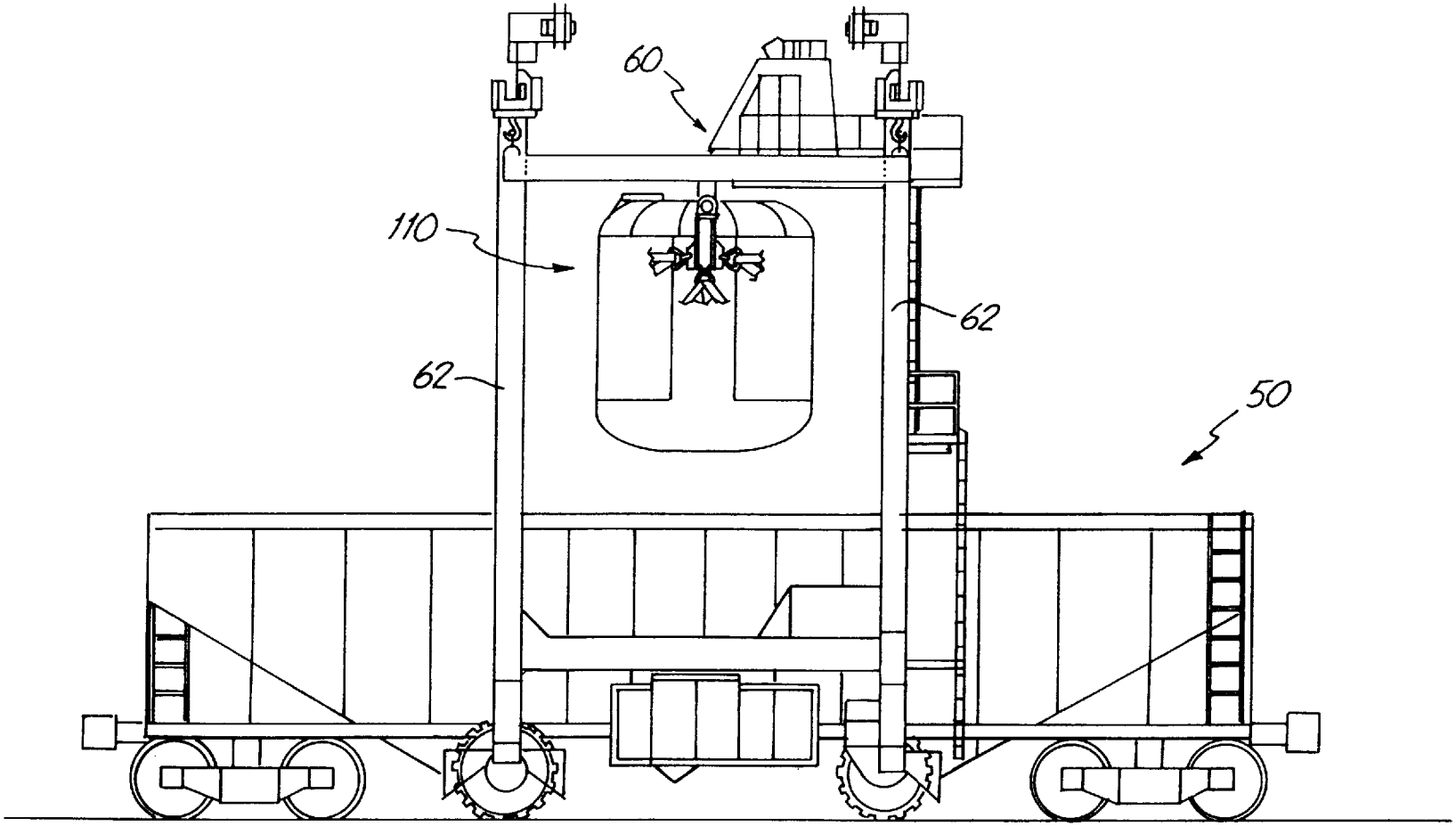

Referring to FIGS. 18A and 20A–B, the lifting bar 175 is connected to a crane 60 by cables 65. The lifting bar 175 operates by retracting the rods 179 and positioning the lifting bar 175 either between or outside the lifting means 130 attached to opposing sides of the container 110. In the embodiment where the lifting bar 175 is positioned between the lifting member 130, the actuators 177 are then activated moving the rods 179 to their extended position so that the mating fittings 183 are received within the corresponding fittings 146 in the upper portion of the lifting means 130. The container 110 may then be lifted to load or unload a freight car the cables 65 attached to the lifting bar 175.

Figure 18B:
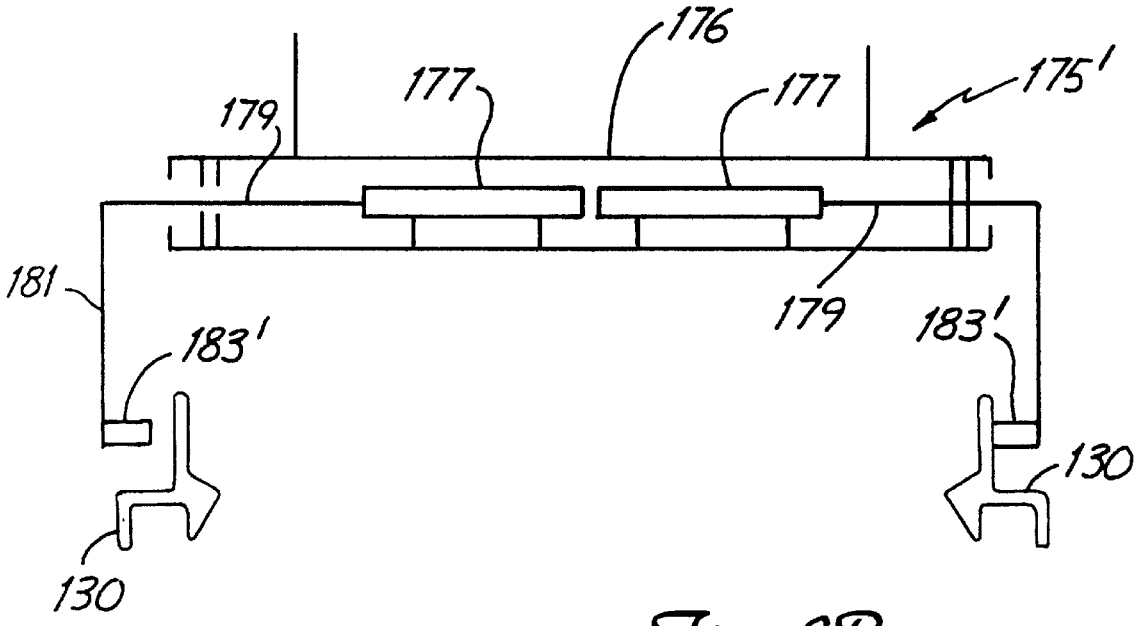

FIG. 18B shows an alternative embodiment of the lifting bar. In FIG. 18B, a lifting bar 175' is positioned outside of the lifting members 130. The lifting bar 175' may include an actuator 177 connected to a rod 179, from which an arm 181 depends. A mating fitting 183' may be carried by the arm 181 so that the mating fitting 183' faces inwardly towards the center of the container 210. The lifting bar 175' operates by moving the mating fitting between a retracted position and an extended position. Unlike the lifting bar 175, the lifting bar 175' engages the lifting member 130 when the mating fitting 183' is in the retracted position, and releases the lifting member 130 when the mating fitting 183' is in the extended position.

Figure 19:
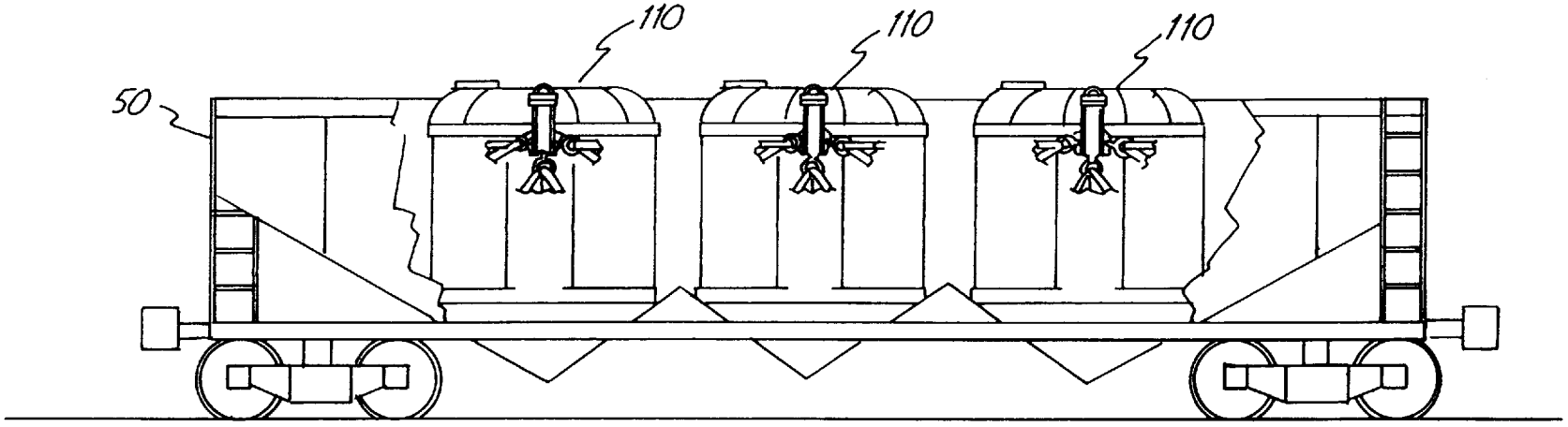
FIG. 19 is a cut-away view of a rail car loaded with filled container of the invention.

FIGS. 19 and 20A–20D depict the container 110 being unloaded from a rail car 50. Initially, a number of containers 110 are positioned in a rail car 50, as best seen in FIG. 19. Although FIG. 19 shows three containers, it is to be understood that the number of containers carried by a single rail car may vary.

The containers 110 may be unloaded by a crane 60 in the manner described above and loaded onto a truck trailer 49. The container may be released from the lifting bar 175 by reactivating the actuators 177 moving the rods 179 to their retracted position so that the mating fittings 183 are withdrawn from the fitting 146 in the upper portion of the lifting member 130.

FIGS. 19 and 20A–20B show the container 110 converting a conventional coal hauling rail car 50 into a rail car that can haul small particle sized materials such as fly-ash and dried coal that would otherwise blow away in an open-top coal car. The rail car 50 is also converted into a car that can haul sewage sludge, oil, gas or other chemicals that would otherwise sully the car or be too dangerous to haul without being encapsulated. Similarly, the truck trailer 49 is converted from a mere flat bed vehicle into a vehicle that can haul virtually any type of bulk material in large quantities.

Figure 21:
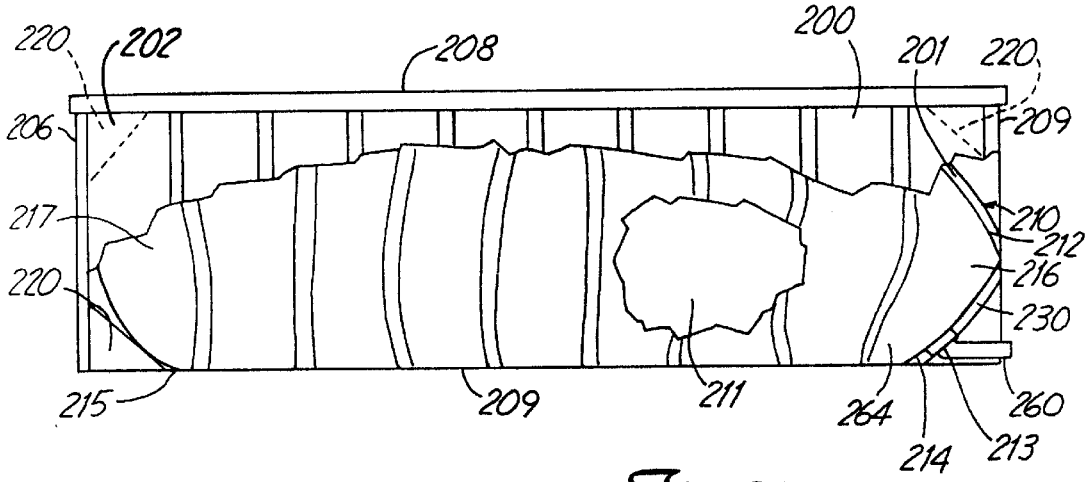
FIG. 21 depicts an alternative embodiment of a container of the present invention.
Figure 22:
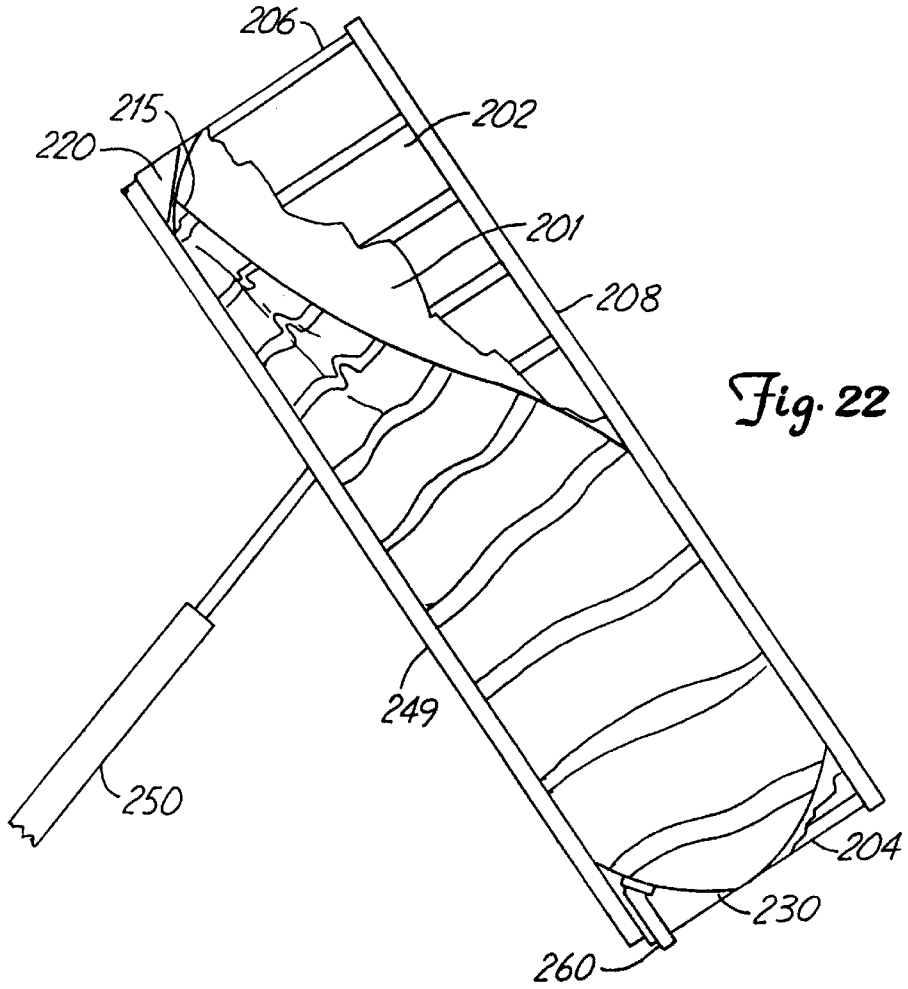
FIG. 22 depicts an alternative embodiment of a container of the present invention.
Figure 23:
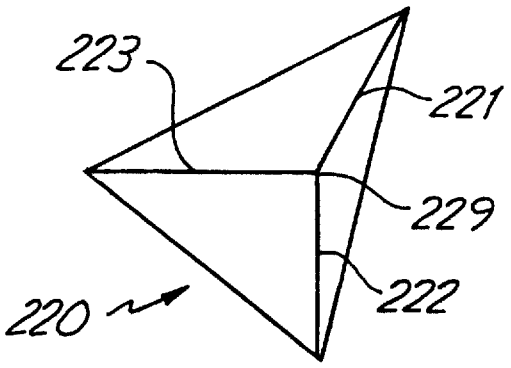
FIG. 23 depicts a corner support used in an embodiment of the invention depicted in FIGS. 21 and 22.
Figure 24:
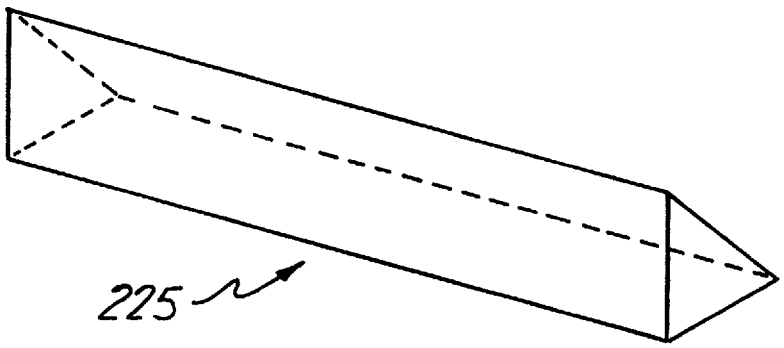
FIG. 24 depicts an elongated support used in an embodiment of the invention shown in FIGS. 21 and 22.

FIGS. 21 and 22 depict yet another embodiment of the invention. A collapsible container 210 is positioned within an intermodal ISO shell 200 of the type used in hauling items or packages on ships, trucks and rail cars. The shell 200 may include two generally parallel sidewalls 202 connected to a first end wall 204 on a first end and a second end wall 206 on a second end. The sidewalls 202 and end walls 204, 206 may be supported by a floor 209 and covered by a ceiling 208 so that the sidewalls, endwalls, floor and ceiling define a chamber 201.

A collapsible container 210 is disposed within the chamber 201 for carrying bulk materials that cannot ordinarily be transported using ISO shells alone. A number of supports 220, 225 may be positioned in the corners of the chamber 201 to support the container 210 in the square corners of the chamber. The supports 220, 225 provide additional support to the container 210, which will naturally tend to have a more rounded configuration than the sharply angular cavity 201 of the ISO shell. The supports desirably provide sufficient support to enable the container 210 to be made of relatively few plies, while still being able to hold several tons of material without undue stress on the container.

The supports 220 may have a generally pyramidal shape defined by an apex 224, a vertical edge 222 and two horizontal edges 221, 223 as shown in FIG. 22. The support 220 may be positioned so that the apex 224 is adjacent a corner of the chamber 220. The supports 225 may have an elongated shape and be positioned along the interface of a side wall and the floor or ceiling. The supports 220, 225 may be made from any suitable material, such as a high density polyurethane foamed material, such as is commercially available from the React Company. Aluminum or any other metal may also suffice and may be better in certain applications, e.g. where wear resistance is more important.

The chamber 201 may also have a funnel 230 positioned at its first end for directing the flow of the materials within the container 210 towards the port 214 as they are discharged from the container 210. The funnel 230 may extend from an intermediate point along the side walls 202 towards the center of the first end wall 204. The funnel 230 may alternatively extend from an intermediate point along the side walls 202, floor 209 and ceiling 208 towards the first end wall 204.

The port 214 may be positioned in the lower portion of the container 210 and connected to the interior funnel 230 as shown in FIG. 21 or directly connected to the end wall 204 (not shown). In another embodiment, the port 214 may be connected to a coupling 216 positioned in either the funnel 230 or the end wall 204. By directly connecting the port 214 in such a manner, the bulk materials in the container may be accessed without having to access the chamber 201.

The container 210 is similar to the container 110, except that the container 210 does not necessarily need the lifting members 130 or straps 160, 161, 162. Instead, a second end 217 of the container 210 is releasably attached to the second end of the shell 200 by a tether 215 or the like, and has several radial bands 264 for supporting the bulk materials being hauled in the container 210. The radial bands 264 compressively support the walls of the container 210 to avoid stress on the walls of the shell 200, particularly such as may otherwise occur when the materials in the container shift during handling.

The container 210 may be filled in substantially the same manner as the container 110. The container 210 may be emptied by placing the shell 200 on a tiltable surface 249 supported by a hydraulic cylinder 250 or the like, such as is commonly found on many dump trucks. In one embodiment, fluidized dried coal may be gravitationally discharged from the container 210 through a sleeve 260 attached to the port 214 without having to directly access the chamber 201. The sleeve 260 may direct the fluidized dried coal to a hose 261 leading to a power plant. Similarly, the cavity 211 of the container may be filled through the sleeve 260 without having to directly access the chamber 201. The container 210 is especially useful for hauling finely divided or dried coal to power plants.

As will be well understood by those skilled in the art, a barrier in accordance with the present invention can be made by any of a variety of different known processes. However, in one particularly preferred embodiment, the barrier is made by using a two-part mold to form two barrier segments and bonding these segments to one another.

In accordance with this method, two molding segments (not shown) are provided, with an upper molding segment being adapted to form an upper segment of the barrier and a lower molding segment being shaped to form a lower segment of the barrier. Each of these molding segments maybe formed of a fairly rigid material defining the overall shape of the respective barrier segments. Although the structure of the molding segments can be varied as needed, in a preferred configuration the molding segments comprise a rigid sheet of metal or the like defining the shape of the barrier segment and a relatively lightweight internal skeleton for structural reinforcement For example, the molding segments may be formed of an aluminum shell having a series of aluminum braces or struts within the shell to provide structural stability. For reasons outlined below, the shell is optimally provided with a series of space-apart holes for the passage of air therethrough.

The relative sizes and shapes of the two barrier segments can be varied as desired. However, it has been found that the forming operation can be made easier if the upper segment of the barrier comprises the upper portion of the barrier, as referred to above, and the lower segment generally includes the sidewall and the lower portion of the barrier, as also referred to above. Since the web and reinforcement panels optimally do not extend through the upper portion of the barrier, the web can be formed integrally with the sidewall and the lower portion of the barrier as outlined below.

The plies of materials that form the barrier segments are each formed around their respective molding segments. As outlined above, the barrier may be made from several plies of a combination of rubber, nylon, nitrylvinyl and Kevlar™. The materials may be formed to the molding segments by wrapping the materials around the molding segments and holding the materials against the molding segments. In addition to the materials that make up the plies of the barrier segments, the web and reinforcement panels may be appropriately positioned between the plies before the materials are subject to a heat treatment process. In one embodiment, the plies of materials are held into position against the molding segments by drawing a vacuum within the shell of the molding segments. The vacuum acts through the holes in the shell to pull the plies of materials against the shell.

The plies of materials are then bonded together and shaped by a heat treatment process as they are being held against the molding segments. Additionally, the web and reinforcement panels that are positioned between the plies of materials are also bonded to the plies. In some embodiments, the materials are cured over a period of time to enhance the bonding and shaping of the various materials. The temperatures and time of the heat treatment will vary with the type and number of materials being molded as is well known to a person having ordinary skill in the art.

After the heat treatment process, the barrier segments are removed from the molding segments. In one embodiment, the barrier segments are removed from the molding segments by injecting air into the shell of the molding segments to create an air pocket between the shell and its respective barrier segment. The barrier segment may then be easily separated from the molding segment.

The barrier of the container is formed by attaching the upper barrier segment to the lower barrier segment. The barrier segments may be attached by a ring press that heats and presses an overlapping area of the two barrier segments. In a preferred embodiment, a bonding agent may be used between the barrier segments where they overlap in conjunction with the ring press.

While a preferred embodiment of the invention has been described, it should be understood that various changes, adaptations and modifications may be made therein without departing from the spirit of the invention in the scope of the appended claims.

What is claimed is:

1. A collapsible container for hauling materials, comprising:

a generally flexible barrier defining a collapsible cavity, the barrier having an upper portion, a lower portion and a sidewall;

a port having a periphery, the port extending through the upper portion of the barrier for passing the material into and out of the cavity;

a cover attached to the barrier for closing the port;

a lifting member attached to the upper portion for engagement with a crane, the lifting member having a fitting for engaging a lifting bar carried by the crane and an arm for engaging a freight vehicle;

a strap attached to the lifting member and the barrier; and a ring attached to the lower portion of the barrier for holding the container as the container is inverted so that the materials may be evacuated through the port when the cover is removed therefrom.

2. The container of claim 1, wherein the barrier is made from a plurality of plies of materials selected from the group consisting of rubber, nylon, nitrylvinyl nylon and Kevlar, the plies being positioned so that the barrier has an outer ply and at least one inner ply.

3. The container of claim 2, wherein each ply is bonded to an adjacent ply.

4. The container of claim 1, wherein the cover comprises a sleeve attached to the barrier adjacent the periphery of the port.

5. An intermodal container, comprising:

a shell having two generally parallel side walls, a first end wall connected to the side walls at a first end, a second end wall connected to the side walls at a second end, a floor supporting the side walls, first end wall and second end wall and a ceiling connected to the side walls, first end wall and second end wall, the floor, ceiling, side walls, and first and second end walls defining a chamber, wherein at least the first end wall has a door for accessing the chamber;

a collapsible container positioned within the shell, the collapsible container being made from a flexible barrier configured to have first and second ends and defining a cavity, a port in the first end of the barrier connected to the shell for passing bulk materials into and out of the cavity, and a plurality of radial bands attached to the barrier and circumferentially extending about the barrier;

wherein, the first end of the barrier is positioned in the chamber towards the first end wall to access the port and the second end of the barrier is positioned in the chamber towards the second end wall, the second end of the container being attached to the shell.

6. The container of claim 5 wherein the chamber of the shell includes angular corners, further comprising at least one support positioned at one of the angular corners to define a more rounded cavity.

7. The container of claim 6 wherein a plurality of supports are provided, one support being positioned at each corner defined in part by the first end wall and the floor, by the first end wall and the ceiling, or by the second end wall and the ceiling.

8. The container of claim 6 wherein the support is generally pyramidical in shape.

9. The container of claim 5 further comprising a funnel directing the flow of material within the container toward the port.

10. The container of claim 5 further comprising a conduit connecting the port in the collapsible container to a port in the first end wall of the shell.

11. A collapsible container for hauling materials, comprising:

a generally flexible barrier defining a collapsible cavity, the barrier having an upper portion, a lower portion, a sidewall and a wear guard positioned on the exterior of the barrier where the barrier contacts a transport vehicle;

a port having a periphery, the port extending through the upper portion of the barrier for passing the material into and out of the cavity;

a cover attached to the barrier for closing the port;

a lifting member attached to the upper portion for engagement with a crane, the lifting member having a fitting for engaging a lifting bar carried by the crane and an arm for engaging a freight vehicle;

a strap attached to the lifting member and the barrier; and a ring attached to the lower portion of the barrier for holding the container as the container is inverted so that the materials may be evacuated through the port when the cover is removed therefrom.

12. The container of claim 11, wherein the wear guard is made from a material from the group consisting of rubber, nylon, nitrylvinyl nylon and Kevlar.

13. A collapsible container for hauling materials, comprising:

a generally flexible barrier defining a collapsible cavity, the barrier having an upper portion, a lower portion and a sidewall;

a port having a periphery, the port extending through the upper portion of the barrier for passing the material into and out of the cavity;

a cover attached to the barrier for closing the port, said cover comprising a sleeve limiting escape of bulk materials as they are passed through the port;

a lifting member attached to the upper portion for engagement with a crane, the lifting member having a fitting for engaging a lifting bar carried by the crane and an arm for engaging a freight vehicle;

a strap attached to the lifting member and the barrier; and a ring attached to the lower portion of the barrier for holding the container as the container is inverted so that the materials may be evacuated through the port when the cover is removed therefrom.

14. The container of claim 13, wherein the sleeve is made from a flexible material being substantially impermeable to material having a particle size of at least about 0.002 inches.

15. A collapsible container for hauling materials, comprising:

a generally flexible barrier defining a collapsible cavity, the barrier having an upper portion, a lower portion and a sidewall;

a port having a periphery, the port extending through the upper portion of the barrier for passing the material into and out of the cavity;

a cover attached to the barrier for closing the port;

a lifting member attached to the upper portion for engagement with a crane, the lifting member having a fitting for engaging a lifting bar carried by the crane and an arm for engaging a freight vehicle, the arm being vertically adjustable with respect to the fitting between an upper position and a lower position;

a strap attached to the lifting member and the barrier; and a ring attached to the lower portion of the barrier for holding the container as the container is inverted so that the materials may be evacuated through the port when the cover is removed therefrom.

16. A collapsible container for hauling materials, comprising:

a generally flexible barrier defining a collapsible cavity, the barrier having an upper portion, a lower portion and a sidewall;

a port having a periphery, the port extending through the upper portion of the barrier for passing the material into and out of the cavity;

a cover attached to the barrier for closing the port;

a lifting member attached to the upper portion for engagement with a crane, the lifting member having a fitting for engaging a lifting bar carried by the crane and an arm for engaging a freight vehicle;

a plurality of straps forming a web attached to the lifting member and the barrier; and a ring attached to the lower portion of the barrier for holding the container as the container is inverted so that the materials may be evacuated through the port when the cover is removed therefrom.

17. A collapsible container for hauling materials, comprising:

a generally flexible barrier defining a collapsible cavity, the barrier having an upper portion, a lower portion, a sidewall and a radial band extending about the circumference of the barrier;

a port having a periphery, the port extending through the upper portion of the barrier for passing the material into and out of the cavity;

a cover attached to the barrier for closing the port;

a lifting member attached to the upper portion for engagement with a crane, the lifting member having a fitting for engaging a lifting bar carried by the crane and an arm for engaging a freight vehicle;

a strap attached to the lifting member and the barrier; and a ring attached to the lower portion of the barrier for holding the container as the container is inverted to so that the materials may be evacuated through the port when the cover is removed therefrom.

* * * * *